US009173515B2

(12) United States Patent
Louw

(10) Patent No.: US 9,173,515 B2
(45) Date of Patent: Nov. 3, 2015

(54) INDICATOR FOR GARMENT HANGERS

(76) Inventor: Henry John Louw, Bergvliet (ZA)

( * ) Notice: Subject to any disclaimer, the term of this patent is extended or adjusted under 35 U.S.C. 154(b) by 0 days.

(21) Appl. No.: 11/432,819

(22) Filed: May 11, 2006

(65) Prior Publication Data

US 2007/0062984 A1 Mar. 22, 2007

(30) Foreign Application Priority Data

May 11, 2005 (ZA) ..... 2005/03778

(51) Int. Cl.
*A41D 27/22* (2006.01)
*A47G 25/14* (2006.01)

(52) U.S. Cl.
CPC ..... *A47G 25/1428* (2013.01)

(58) Field of Classification Search
CPC ..... A47G 25/1407; A47G 25/1414; A47G 25/1421; A47G 25/1428; A47G 25/1435; G09F 3/08; G09F 3/16; G09F 3/18
USPC ..... 223/85, 88, 92, 95; 40/322; D6/328
See application file for complete search history.

(56) References Cited

U.S. PATENT DOCUMENTS 1,389,266 A * 8/1921 Newton ..... 40/322
1,544,844 A * 7/1925 Levkowits ..... 40/5
2,690,863 A * 10/1954 Adelman ..... 40/322
3,535,808 A * 10/1970 Morrish ..... 40/322
4,198,773 A * 4/1980 Batts et al. ..... 40/322
4,322,902 A * 4/1982 Lenthall ..... 40/322
4,333,590 A * 6/1982 Princiotta ..... 223/85
4,679,340 A * 7/1987 Johansson ..... 40/322
4,881,836 A * 11/1989 Blanchard ..... 40/322
5,056,248 A * 10/1991 Blanchard ..... 40/322
5,503,310 A * 4/1996 Zuckerman et al. ..... 223/85
6,409,057 B1 * 6/2002 Kim ..... 223/85
6,467,659 B2 * 10/2002 Gouldson ..... 223/96
6,726,067 B2 * 4/2004 Louw ..... 223/85
D510,198 S * 10/2005 Willardson ..... D6/328
7,287,674 B1 * 10/2007 Sutton et al. ..... 223/85
7,516,875 B2 * 4/2009 Gouldson ..... 223/85
2002/0095829 A1 * 7/2002 I-wen ..... 40/322
2002/0113100 A1 * 8/2002 Gouldson ..... 223/96
2006/0006204 A1 * 1/2006 Mainetti ..... 223/85
2006/0213938 A1 * 9/2006 Gouldson ..... 223/85
2007/0199963 A1 * 8/2007 Gouldson ..... 223/85

* cited by examiner

*Primary Examiner* — Nathan Durham
(74) *Attorney, Agent, or Firm* — Ostrolenk Faber LLP

(57) ABSTRACT

An indicator for a hanger includes a body having side walls and joining end walls, openings at opposing top and bottom ends, and a passage extending through the body and joining the openings. The indicator may be positioned around a hook of the hanger such that the hook extends from the opening at the top end of the body. The indicator may also include an attachment mechanism for securing the indictor to the hanger. Alternatively or in addition, the hanger may include a mechanism for securing the indictor to the hanger. Information may be displayed on one or more of the side walls and end walls of the indicator.

3 Claims, 7 Drawing Sheets

INDICATOR FOR GARMENT HANGERS

RELATED APPLICATIONS

This application is based on claims priority to South African Provisional Patent Application No. 2005/03778, filed on May 11, 2005, by Henry John Louw, entitled "INDICATOR DEVICE," the contents of which are herein incorporated by reference.

FIELD OF THE INVENTION

This invention relates to hangers for articles, and more specifically, relates to indicators that may be joined to the hangers for specifying information associated with the articles hanging therefrom.

BACKGROUND OF THE INVENTION

A garment hanger is often provided with an indicator (i.e., indictor device) that specifies a size of a garment supported from the hanger. The indicator is normally positioned either on a hook or a central hook boss/neck portion of the hanger such that the information on the indicator is visible from the front and back faces of the hanger.

Notably, locating the indicator in this fashion causes difficulty when multiple hangers and associated garments are suspended from display racks/rails in shops. In particular, when a number of hangers are hanging from a rack, the hangers are typically positioned in close proximity to one another, with the front and back faces of the hangers pressed up against each other, thereby concealing the information on the indicators. As a result, customers must force the hangers apart to be able to see the information on the indicators. The customers must repeat this process until the desired hanger/garment is found.

Notably, customers also often remove hangers from a rack to properly view garments, and then return the hangers to incorrect positions on the rack, resulting in the garments being haphazardly orientated with respect to information on the indicators. As a result, the staff of a shop must occasionally check the racks to re-orient the hangers as necessary. However, like the customers, the staff must force the hangers apart to be able to see the indicators, thereby making this process slow.

BRIEF SUMMARY OF THE INVENTION

Accordingly, it is desirable to provide an indicator for a garment hanger that allows both customers and staff to more easily view the information on the indicator, thereby overcoming the above and other disadvantages of the prior art. According to an embodiment of the invention, an indicator includes a body having a first opening formed in a top end thereof and a second opening formed in an opposing bottom end thereof. The body also includes first and second opposing side walls and first and second opposing end walls that join the side walls. The side walls and end walls are configured to form a passage that extends through the body and joins the opposing openings.

According to an embodiment of the invention, one or both side walls may also include a respective leg extension that extends to a length below the end walls. In this configuration, the side walls are longer than the end walls.

According to an embodiment of the invention, one or more of the side walls and end walls may each include one or more display surfaces for displaying information. The information may include alphanumeric size measurement of a garment supported on an associated hanger, a company logo or trademark, an advertisement, a price, etc.

According to an embodiment of the invention, the indicator may be positioned on a hanger that includes a body portion and a hook secured to the body portion. In particular, according to an embodiment of the invention, the indicator may be configured to receive the hook of the garment hanger such that the indicator abuts against the body portion of the hanger and is located around the hook with the hook extending through the passage of the indicator body and outward from the opening at the top end of the indicator body.

According to an embodiment of the invention, the indicator may include one or more attachment mechanisms situated within the passage of the body on each of the respective side walls and in particular, situated along the respective leg extensions. These attachment mechanisms may be configured to detachably secure the indicator to the hanger. According to an embodiment of the invention, the attachment mechanisms may be abutments that detachably secure the indicator to the body portion of the hanger.

According to another embodiment of the invention, an indicator includes a body having first and second opposing openings, first and second opposing side walls and first and second opposing end walls that join the side walls, and a passage that extends through the body and joins the opposing openings, as described above. According to an embodiment of the invention, the indicator may be positioned on a hanger that includes a body portion, a hook boss secured to the body portion, and a hook secured to the hook boss. In particular, according to an embodiment of the invention, the indicator may be configured to receive the hook of the garment hanger such that the indicator abuts against the body portion of the hanger and is located around the hook boss with the hook extending outward from the opening at the top end of the indicator body.

According to an embodiment of the invention, the hook boss may include a tab that is configured to engage an outer surface of the top end of the indicator body. In this fashion, the indicator is secured between the tab and body portion of the hanger.

According to an embodiment of the invention, one or more locators may also be positioned on the body portion of the hanger. These locators may be configured such that when the indicator is secured to the hanger, these locators are positioned within the passage of the indicator body and engage the end walls of the indicator body. In this fashion, the indicator is prevented from spinning.

According to another embodiment of the invention, one or both side walls of the indicator may also include a respective leg extension that extends to a length below the end walls.

According to another embodiment of the invention, the indicator may also include one or more attachment mechanisms situated within the passage of the body on each of the respective side walls and that are configured to secure to the body portion of the hanger.

Advantageously, an indicator of the present invention may be positioned on a hanger such that the indicator displays information that is easily viewed from all different directions, including from the front and back faces of the hanger and from opposing sides of the hanger. Accordingly, a plurality of hangers each having an indicator of the present invention may be situated on a store display rack in different orientations without obscuring the visibility of the information on the indicators. In particular, a plurality of hangers may be situated on a rack in close proximity to one another thereby still allowing the information on the indicators to be seen.

Other features and advantages of the present invention will become apparent from the following description of the invention which refers to the accompanying drawings.

DETAIL DESCRIPTION OF THE INVENTION

Figure 1:
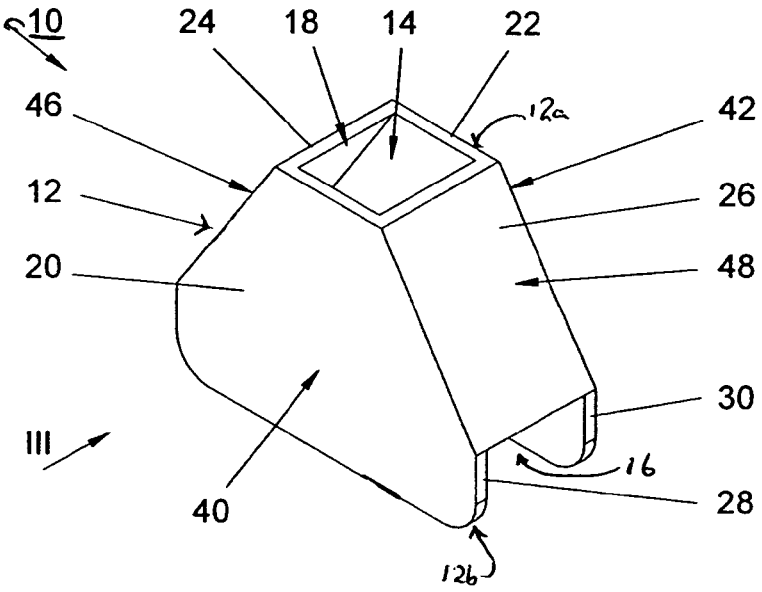
FIG. 1 shows a top perspective view of an indicator according to an embodiment of the invention.

Referring to FIGS. 1-5, there is shown an indicator 10 according to an embodiment of the invention. Indicator 10 includes a body 12 having a top end 12*a* and a bottom end 12*b*. Formed within top end 12*a* of body 12 is a first opening 18 and formed within bottom end 12*b* is a second opposing opening 16. Body 12 also includes first and second opposing side walls 20 and 22, and first and second opposing end walls 24 and 26 that join side walls 20 and 22. Side walls 20 and 22 and end walls 24 and 26 are configured to form a passage 14 that extends through body 12 and joins openings 18 and 16. As further described below, passage 14 may be configured to have a size such that a portion of a garment hanger, such as the hook, may be positioned within the passage, thereby positioning indicator 10 around the hook.

Indicator 10 may be formed of plastic or metal, for example, or any other suitable material or combination of materials known in the art. According to an embodiment of the invention, indicator 10 may be made of plastic and formed using an injection molding process.

Figure 3:
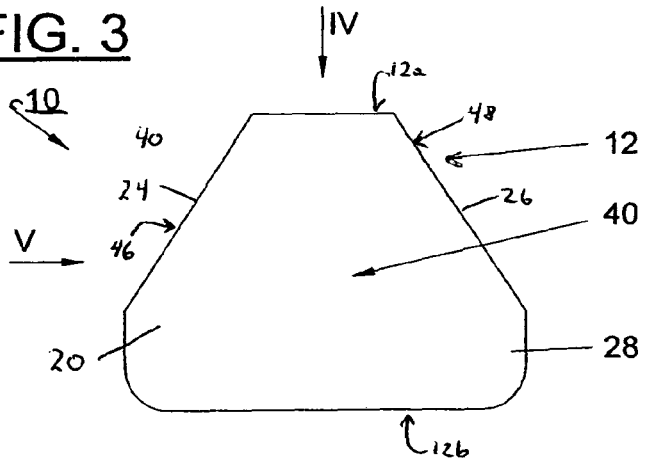
FIG. 3 shows a front view of the indicator of FIG. 1, as seen along arrow III of FIG. 1.
Figure 4:
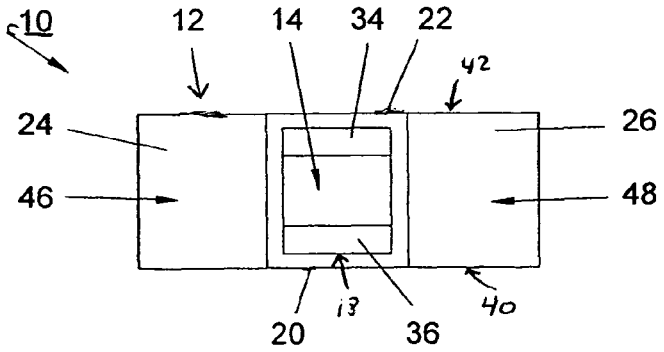
FIG. 4 shows a top view of the indicator of FIG. 1, as seen along arrow IV of FIG. 3.

According to an embodiment of the invention, side walls 20 and 22 may each have a substantially planar configuration and may each include an outwardly directed display surface 40 and 42, respectively. As shown, side walls 20 and 22/display surfaces 40 and 42 may be substantially parallel. End walls 24 and 26 may also each have a substantially planar configuration and may each include an outwardly directed display surface 46 and 48, respectively. According to an embodiment of the invention, end walls 24 and 26/display surfaces 46 and 48 may be angled inwards towards one another from the bottom end 12*b* towards the top end 12*a* of body 12. In this configuration, body 12 may have a substantially trapezoidal shape, as shown in FIG. 3.

One skilled in the art will recognize that indicator 10 may have configurations other than that shown in the Figures without deviating from the present invention. For example, end walls 24 and 26/display surfaces 46 and 48 may be substantially parallel, thereby giving body 12 a rectangular or square type shape. Similarly, rather than each side wall and/or each end wall having a single display surface, the side walls and/or end walls may include a plurality (i.e., two or more) of display surfaces.

According to an embodiment of the invention, one or both side walls 20 and 22 may each include a leg extension 28 and 30, respectively, that extends to a length below end walls 24 and 26. In this configuration, the side walls are longer than the end walls and have increased display surfaces 40 and 42.

According to an embodiment of the invention, information may be displayed on one or more of display surfaces 40, 42, 46, and 48. This information may include an alphanumeric size measurement (e.g., S, M, L, 6, 8) of a garment supported on an associated hanger. Alternatively, the information may be a company logo, trademark, or the like of a garment supported on the associated hanger. As another alternative, the information may be an advertisement. As a further alternative, the information may be a price of a garment. One skilled in the art will recognize that other types of information are possible. One skilled in the art will also recognize that a combination of different types of information may be displayed on the display surfaces. The information may be formed on the surfaces using any method known in the art. For example, the information may be printed on the display surfaces, molded into the display surfaces, or applied using an adhesive.

Figure 6:
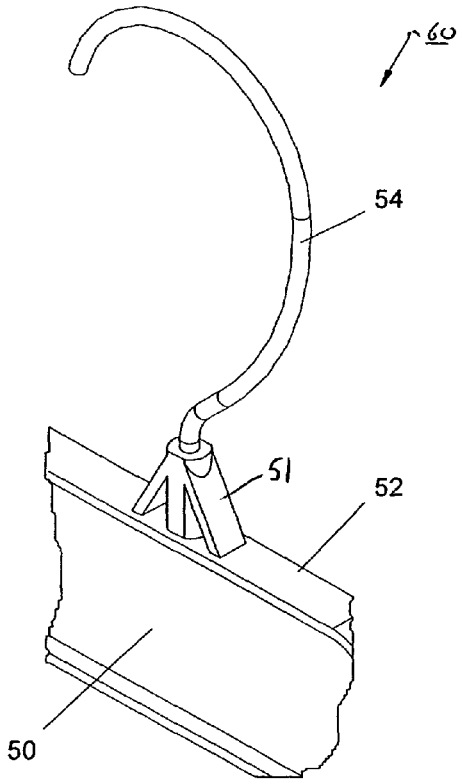
FIG. 6 (Prior Art)
FIG. 6 shows a partial perspective view of a hanger of the prior art.
Figure 7:
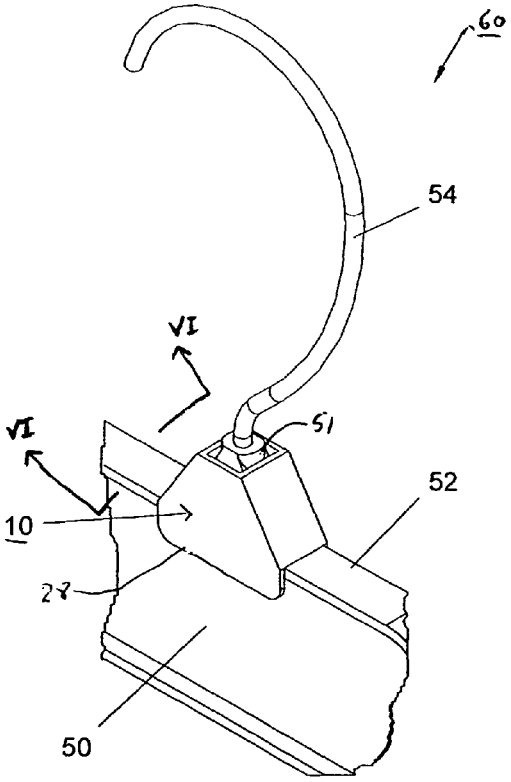
FIG. 7 shows the indicator of FIG. 1 secured to the hanger of FIG. 6, according to an embodiment of the invention.
Figure 8A:
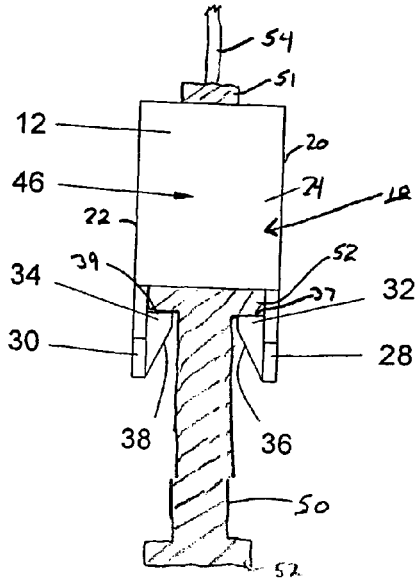
FIG. 8A shows a left side view of the indicator and hanger of FIG. 7 according to an embodiment of the invention, FIG. 8A being seen along arrows VI of FIG. 7.
Figure 8B:
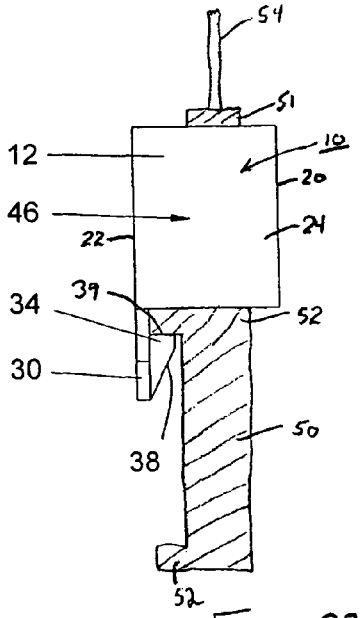
FIG. 8B shows a left side view of an indicator secured to a hanger according to another embodiment of the invention.

Referring now to FIGS. 6 and 7, there is shown an example hanger 60 of the prior art and indicator 10 joined to this hanger according to an embodiment of the invention. Hanger 60 includes a body portion/support portion 50 and a hook 54 that has a hook boss/neck portion 51 that secures hook 54 to body portion 50. Body portion 50 may also include an outwardly projecting strengthening rib 52 at its outer edges. In particular, according to an embodiment of the invention, body portion 50 and strengthening rib 52 may have an "I beam" configuration, as shown in FIGS. 6, 7, and 8A. According to another embodiment of the invention, body portion 50 and strengthening rib 52 may have an "C beam" configuration, as shown in FIG. 8B. Body portion 50, strengthening rib 52, and hook boss 51 may be formed of plastic and hook 54 may be formed of metal. Nonetheless, the present invention is not limited to such a hanger and hanger 60 may be formed of other materials. For example, hook 54 may be formed of plastic.

According to an embodiment of the invention, indicator 10 is joined to hanger 60 by passing the indicator over hook 54 such that the hook enters second opening 16, extends through passage 14, and exits through first opening 18 of the indicator. Thereafter, indicator 10 is brought into abutment with body portion 50/strengthing rib 52 of hanger 60, as shown in FIG. 7. In this configuration, indicator 10 surrounds hook 54 and hook boss 51, with hook 54 extending outward from opening 18 at top end 12*a* of the indicator. As shown, when legs 28 and/or 30 are present, they may extend along body portion 50. In this configuration, legs 28 and 30 may prevent indicator 10 from rotationally spinning on hanger 60.

Figure 2:
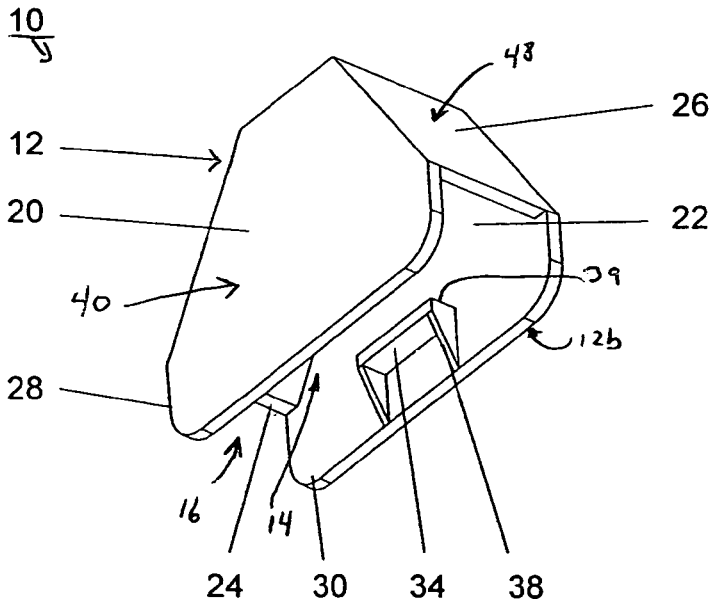
FIG. 2 shows a bottom perspective view of the indicator of FIG. 1, according to an embodiment of the invention.
Figure 5:
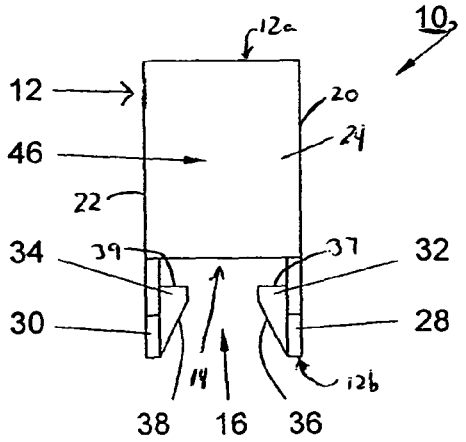
FIG. 5 shows a left side view of the indicator of FIG. 1, as seen along arrow V of FIG. 3.

According to an embodiment of the invention, indicator 10 may also be secured to hanger 60. In particular, according to an embodiment of the invention and as shown in FIGS. 2 and 5, one or both side walls 20 and 22 may each include one or more attachment mechanisms, such as abutments 32 and 34, situated within passage 14. According to an embodiment of the invention, abutments 32 and 34 may be situated on a respective leg extension 28 and 30, although other positions are possible. According to an embodiment of the invention, each abutment 32 and 34 may be configured as a ramp 36 and 38 that angles inward into passage 14 from bottom end 12*b* towards top end 12*a* of body 12. In addition, each ramp may culminate in a ledge 37 and 39.

Referring to FIG. 8A, according to an embodiment of the invention, indicator 10 may be configured to be secured to a hanger 60 having a body portion 50 and strengthening rib 52 configured as an "I beam". According to this embodiment of the invention, both side walls 20 and 22 may include a respective leg extension 28 and 30 and each leg extension may include a respective abutment 32 and 34. In this configuration, as indicator 10 is joined to hanger 60 as described above, the indicator may be secured to the hanger by forcing the indicator against strengthening rib 52. In this fashion, strengthening rib 52 slides along ramps 36 and 38, causing legs 28 and 30 to outwardly deflect until abutments 32 and 34 move over the strengthening rib. Thereafter, indicator 10 clips to strengthening rib 52 by ledges 37 and 39 engaging an underside of the rib. One skilled in the art will recognize that indicator 10 may have other configurations when secured to a hanger having an "I beam" configuration. For example, the indicator may include two leg extensions, but only one of the two leg extensions may include an abutment. As another example, the indicator may include only one leg extension having a respective abutment.

Referring to FIG. 8B, according to another embodiment of the invention, indicator 10 may be configured to be secured to a hanger 60 having a body portion 50 and strengthening rib 52 configured as a "C beam". According to this embodiment of the invention, one of the two side walls, such as wall 22 may include a respective leg extension 30 and this leg extension may include a respective abutment 34. In this configuration, as indicator 10 is joined to hanger 60 as described above, the indicator may be secured to the hanger by forcing the indicator against strengthening rib 52, thereby causing abutment 34 to secure to the strengthening rib. Again, one skilled in the art will recognize that indicator 10 may have other configurations when secured to a hanger having a "C beam" configuration. For example, the indicator may include two leg extensions, but only one of the two leg extensions may include an abutment.

According to an embodiment of the invention, indicator 10 may also be configured to be removed from hanger 60 once secured thereto. For example, assuming indicator 10 includes one or more abutments 32 and 34 as shown in FIGS. 8A and 8B, indicator 10 may be removed by causing legs 28 and 30 to outwardly deflect until abutments 32 and 34 clear strengthening rib 52.

One skilled in the art will recognize that attachment mechanisms other than abutments 32 and 34 may be used to secure indicator 10 to hanger 60 without deviating from the scope of the present invention. In addition, one skilled in the art will also recognize that the attachment mechanisms of indicator 10 may secure to hanger 60 to a portion other than strengthening rib 52. For example, the attachment mechanisms of indicator 10 may be configured to secure to hook boss 51. One skilled in the art will also recognize that indicator 10 may be secured to a position along hanger 60 other than around hook 54. One skilled in the art will further recognize that indicator 10 may be configured to be permanently secured to hanger 60.

Figure 9:
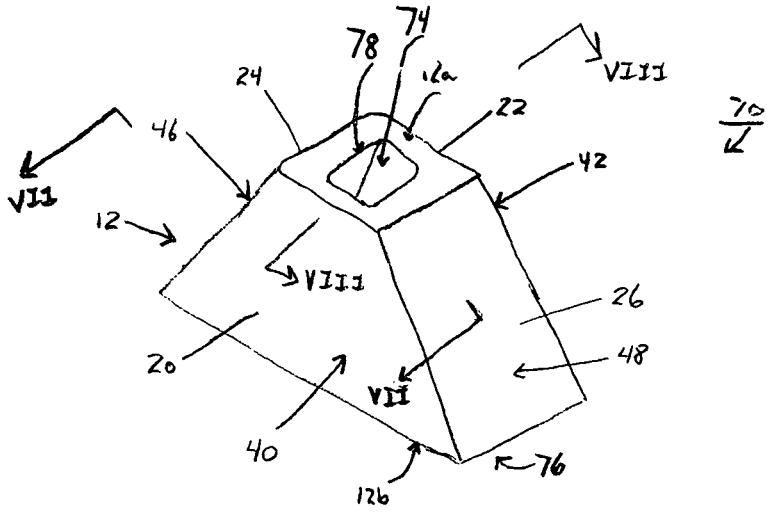
FIG. 9 shows a top perspective view of an indicator according to another embodiment of the invention.

Referring now to FIG. 9, in which the same reference numerals refer to similar elements, there is shown an indicator 70 according to another embodiment of the invention. Indicator 70 is similar to indicator 10 and includes a body 12 having a top end 12*a* and a bottom end 12*b*. Formed within top end 12*a* of body 12 is a first opening 78 and formed within bottom end 12*b* is a second opposing opening 76 (as more easily seen in FIG. 11). Body 12 also includes first and second opposing side walls 20 and 22, and first and second opposing end walls 24 and 26 that join side walls 20 and 22. Side walls 20 and 22 and end walls 24 and 26 are configured to form a passage 74 that extends through body 12 and joins openings 78 and 76. Each of the side walls 20 and 22 and each of the end walls 24 and 26 may also include one or more display surfaces, such as surfaces 40, 42, 46, and 48.

According to an embodiment of the invention, side walls 20 and 22 and end walls 24 and 26 may be configured such that body 12 has a substantially trapezoidal shape. Nonetheless, one skilled in the art will recognize that indicator 70 may have configurations other than that shown in FIG. 9 without deviating from the present invention.

Indicator 70 may be formed of plastic or metal, for example, or any other suitable material or combination of materials known in the art.

Figure 10A:
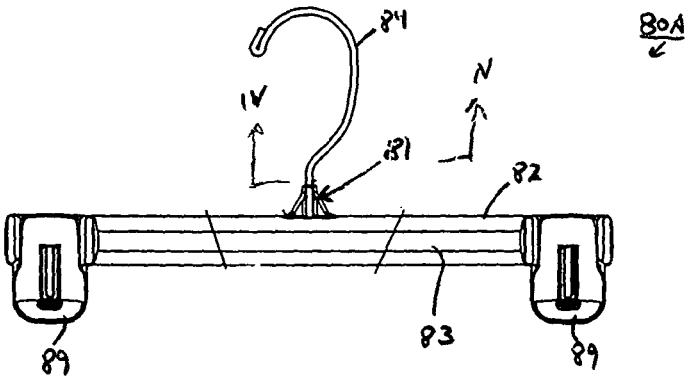
FIGS. 10A and 10B show example hangers according to an embodiment of the invention.

Referring now to FIG. 10A, there is shown a hanger 80A according to an embodiment of the invention. Hanger 80A includes a body portion/support portion 83 and a hook 84 that has a hook boss/neck portion 81 that secures hook 84 to body portion 83. Body portion 83 may also include an outwardly projecting strengthening rib 82 at its outer edges. Body portion 83 and strengthening rib 82 may be configured as an "I beam" or "C beam," for example. Hanger 80A may also include one or more clips 89 at opposing ends of body 83, which clips may have any form known in the art. According to this embodiment of the invention and as described below, hook boss 81 is configured to secure indicator 70 to hanger 80A.

Figure 10B:
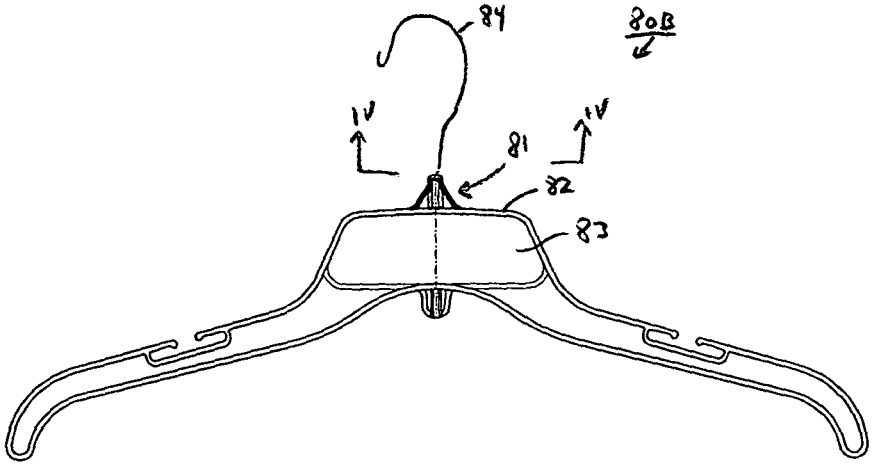

Other than hook boss 81, one skilled in the art will recognize that hanger 80A may have other forms without deviating from the present invention. For example, referring to FIG. 10B, in which the same reference numeral refers to similar elements, there is shown a hanger 80B having a hook boss 81 according to the present invention.

Body portion 83, strengthening rib 82, and hook boss 81 may be formed of plastic and hook 84 may be formed of metal. Nonetheless, the present invention is not limited to such a hanger and hanger 80A/80B may be formed of other materials. For example, hook 84 may be formed of plastic.

Figure 11:
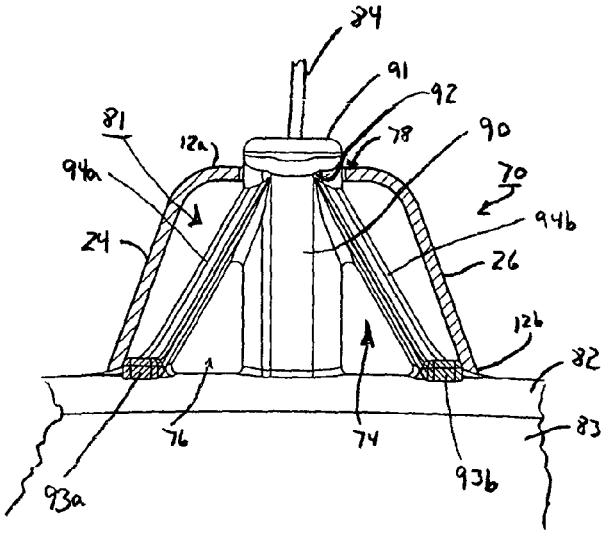
FIG. 11 shows a front view of the indicator of FIG. 9, as seen along arrows VII of FIG. 9, secured to the hanger of FIG. 10A or 10B according to an embodiment of the invention.
Figure 12:
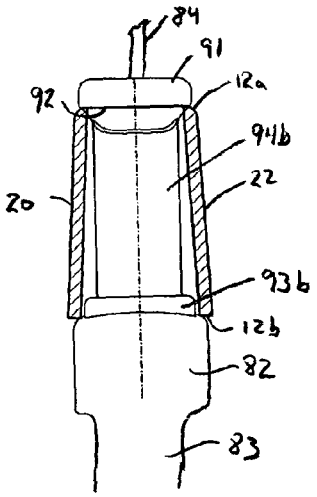
FIG. 12 shows a side view of the indicator of FIG. 9, as seen along arrows VIII of FIG. 9, secured to the hanger of FIG. 10A or 10B according to an embodiment of the invention.
Figure 13:
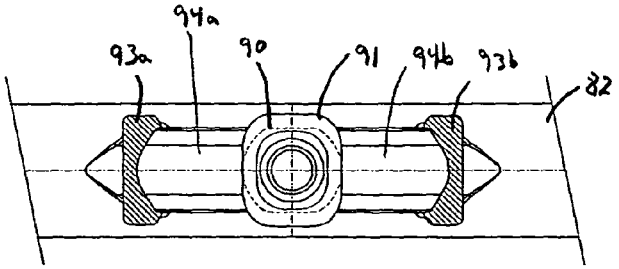
FIG. 13 shows a top view of the hanger of FIG. 10A or 10B, as seen along arrows IV of FIG. 10A/10B, according to an embodiment of the invention.

Referring now to FIGS. 11, 12, and 13, there is shown an expanded view of hook boss 81 according to an embodiment of the invention. Note that FIGS. 11 and 12 show indicator 70 secured to the hook boss/hanger. According to an embodiment of the invention, hook boss 81 includes a body 90 secured at its bottom end to body portion 83/strengthening rib 82 of hanger 80. Hook boss 81 also includes a tab 91 that may be secured to the opposing top end of body 90. As shown, hook 84 may extend outward from tab 91.

According to an embodiment of the invention, tab 91 extends outward beyond the perimeter of body 90, thereby forming a ledge 92. According to an embodiment of the invention and as shown in the Figures, tab 91 may have a disc-like shape, although other shapes are possible, and may extend beyond the perimeter of body 90 along two opposing sides. In this way, ledge 92 is formed on opposing sides of body 90. According to another embodiment of the invention, tab 91 may extend beyond the perimeter of body 90 along something other than two sides, such as one side or all sides. One skilled in the art will recognize that tab 91 does not need to be formed on the top end of body 90 and may be formed along one or more sides of the body. For example, tab 91 may be formed as one or more bumps along body 90.

According to an embodiment of the invention, one or more locators, such as locators 93*a* and 93*b*, may be formed on body portion 83/strengthening rib 82 of the hanger along opposing sides of body 90 of the hook boss. As shown in FIG. 11, hook boss 81 may also include one or more strengthening extensions, such as strengthening extensions 94*a* and 94*b*, that extend from body 90 of the hook boss to body portion 83/strengthening rib 82 of the hanger. Nonetheless, these strengthening extensions are not required. As shown, when strengthening extensions 94*a* and 94*b* are present, locators 93*a* and 93*b* may be formed at the base of these strengthening extensions. One skilled in the art will recognize that hook boss 81 and locators 93*a* and 93*b* may have forms other than that shown in the Figures and as described above, without deviating from the present invention.

Referring now to FIGS. 11 and 12, according to an embodiment of the invention, indicator 70 may be joined to hanger 80 by passing the indicator over hook 84 such that the hook enters second opening 76, extends through passage 74, and exits through first opening 78 of the indicator. Thereafter, indicator 70 is brought into abutment with body portion 83/strengthing rib 82 of hanger 80, as shown in the Figures. In this configuration, indicator 70 substantially surrounds hook boss 81, with hook 84 extending outward from opening 78 at top end 12*a* of the indicator.

More specifically, according to an embodiment of the invention, hook opening 78 may be configured to have a size and/or shape that is smaller, for example, than tab 91 of hook boss 81. In this configuration, as indicator 70 is moved along hook 84 towards body portion 83 as described above, top end 12*a* of body 12 of indicator 70 initially contacts tab 91, the tab being too large to pass through opening 78. Thereafter, indicator 70 is forced against tab 91, which causes body 12 of the indicator to deform/distort/stretch until tab 91 passes through opening 78. Thereafter, body 12 snaps back, with ledge 92 of the hook boss engaging against the outer surface of top end 12*a* of body 12. In this fashion, tab 91 prevents indicator 70 from sliding upwards and off hook 84.

As shown in FIGS. 11 and 12, body 12 of indicator 70 may be sized such that when secured to the hanger, bottom end 12*b* of the body engages body portion 83/strengthening rib 82 of the hanger and top end 12*a* engages ledge 92. In this fashion, the indicator is held securely in place.

As indicated above, one or more locators 93*a* and 93*b* may be positioned on the hanger. According to an embodiment of the invention, body 12 of indicator 70 may be configured such that when the indicator is joined to the hanger, locators 93*a* and 93*b* are positioned within passage 74 and substantially engage end walls 24 and 26. In this fashion, the locators prevent the indicator from partially or totally spinning, for example, around hook 74.

According to an embodiment of the invention, indicator 70 may also be configured to be removed from hanger 80 once secured thereto by forcing the indicator up an against tab 91, thereby causing body 12 to deform and pass over the tab.

According to another embodiment of the invention, one or both side walls 20 and 22 of indicator 70 may each include a leg extension as similarly described above for indicator 10. These leg extensions extend to a length below end walls 24 and 26. In this configuration, the side walls are longer than the end walls and have increased display surfaces 40 and 42. When indicator 10 is secured to hanger 80, these leg extensions may extend along body portion 83. In this configuration, the legs may prevent indicator 70 from rotationally spinning on hanger 80. Accordingly, locators 93*a* and 93*b* may not be required.

According to another embodiment of the invention, indicator 70 may also include one or more attachment mechanisms, such as abutments 32 and 34, situated within passage 74 along one or both side walls 20 and 22, as similarly described for indicator 10. In particular, these attachment mechanisms may be situated on respective leg extensions when present. In this configuration, indicator 70 may secure to a tab 91 of a hook boss 81 of a hanger, may secure to a body portion 83 of a hanger, or may secure to both areas of a hanger.

Advantageously, by placing information, such as size measurements, on display surfaces 40, 42, 44, and 46 of indicator 10 or indicator 70 of the present invention and situating the indicator on any of the hangers as described above, for example, the displayed information may be easily viewed from all different directions, including from the front and back faces of the hanger and from opposing sides of the hanger. Accordingly, a plurality of hangers, for example, each having an indicator of the present invention may be situated on a store display rack in different orientations without obscuring the visibility of the information on the indicators. In particular, a plurality of hangers may be situated on a rack in close proximity to one another thereby still allowing the information on the indicators to be seen. Accordingly, customers may easily view the indicators without having to force the hangers apart. Similarly, store staff may easily check the orientation of the hangers after customers have removed and returned hangers to and from the rack.

As indicated above, according to an embodiment of the invention, indicators 10 and 70 may be configured to be removed from a hanger after being secured thereto. Accordingly, after a garment is sold and removed from a hanger, indicator 10 or 70 may be removed so that a new garment and appropriate indicator may be attached to the hanger.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. In combination:

a garment hanger comprising:

a body portion, a hook boss having a hook boss body secured to said body portion, a hook secured to said hook boss, and a tab extending outward from said hook boss body; and an indicator secured to said garment hanger, said indicator comprising:

an indicator body having a top end and a bottom end, first and second side walls, and first and second end walls connecting said first and second side walls;

an opening defined by said indicator body in each of said top and bottom ends;

a passage through said indicator body, said passage defined by said first and second side walls and said first and second end walls; and wherein said hook boss body is at least partially positioned within said passage, and wherein said tab engages an outer surface of said top end of said indicator body.

2. The combination of claim 1, wherein said garment hanger further comprises one or more locators secured to said body portion, said locators being positioned within said passage and engaging a respective end wall of said indicator.

3. The combination of claim 1, wherein said tab is configured as a circular disk position on a top end of said hook boss body and that extends outward from a periphery of said hook boss body along one or more sides of said hook boss body.

* * * * *